United States Patent [19]

Löbbe

[11] 4,280,735

[45] Jul. 28, 1981

[54] NON-ROTARY MINING CUTTER WITH RECESSED NOZZLE INSERT

[75] Inventor: Armin Löbbe, Oberaden, Fed. Rep. of Germany

[73] Assignee: Gewerkschaft Eisenhütte Westfalia, Fed. Rep. of Germany

[21] Appl. No.: 954,339

[22] Filed: Oct. 25, 1978

[30] Foreign Application Priority Data

Nov. 8, 1977 [DE] Fed. Rep. of Germany ..... 2749830

[51] Int. Cl.[3] ..... E21C 25/60

[52] U.S. Cl. ..... 299/81; 299/17

[58] Field of Search ..... 299/17, 34, 32, 81, 299/91; 175/67, 393

[56] References Cited

U.S. PATENT DOCUMENTS

| | | | |
|---|---|---|---|
| 3,298,451 | 1/1967 | Eckel et al. | 175/393 |
| 3,563,324 | 2/1971 | Lauber | 299/81 X |
| 3,747,982 | 7/1973 | Agnew et al. | 299/81 |
| 3,861,751 | 1/1975 | Erwien | 299/34 X |
| 3,904,247 | 9/1975 | Ostrop | 299/91 |
| 4,025,116 | 5/1977 | Roepke et al. | 299/17 |
| 4,070,064 | 1/1978 | Cobb et al. | 299/81 |

FOREIGN PATENT DOCUMENTS

| | | | |
|---|---|---|---|
| 2210282 | 9/1972 | Fed. Rep. of Germany | 299/81 |
| 672336 | 5/1952 | United Kingdom | 299/17 |

*Primary Examiner*—Ernest R. Purser
*Attorney, Agent, or Firm*—Charles E. Pfund

[57] ABSTRACT

A tool for a mineral winning machine, more usually a plough, has a flat plate-like body with a bore containing a nozzle insert and preferably a hard metal cutting region or blade is also provided on the body. High pressure water is conveyed through the bore and nozzle insert to discharge as a jet which is directed to impinge against the mineral or coal face to effect a cut therein hydraulically. The nozzle insert has its discharge mouth in a protected position inside the body.

14 Claims, 4 Drawing Figures

NON-ROTARY MINING CUTTER WITH RECESSED NOZZLE INSERT

BACKGROUND TO THE INVENTION

The present invention relates to tools for use with mineral winning machines, especially ploughs, and particularly, but not solely, to tools for coal mining.

In high performance underground coal winning it is well known to utilize a plough which is moved back and forth along a coal face to strip coal from the face with the aid of cutter tools. The conventional cutters are usually made from a block of metal to which a hard-metal blade or attachment forming a cutting region is fixed. Usually the cutters are detachably mounted to holders permitting easy replacement of the cutters. It is also known to utilize high pressure water jets to win coal i.e. the so-called hydraulic winning. German Patent specification No. 2307413 describes a coal winning machine provided with nozzles discharging high pressure water for winning coal by the hydraulic method.

A general object of this invention is to provide improved tools and winning machines which will provide high yields with maximum durability.

SUMMARY OF THE INVENTION

According to the invention a tool for a plough is preferably detachably mountable to a holder as known per se and has at least one nozzle for discharging a jet of high pressure fluid or water. Preferably the tool also has a cutting region so that mineral or coal can be won by a combination of mechanical and hydraulic cutting. During use mineral or coal can be pre-cut or loosened by the application of the jet and this aids the normal mechanical cutting or stripping work.

A plough can be equipped with conventional cutters interspersed with tools made in accordance with the invention. The plough can then produce a high output, even under difficult working conditions, and the hydro-mechanical working is additionally useful in extending the life of the cutters. As only some of the tools discharge water jets there need be no difficulty in coping with the quantity of water involved. The water jets are also useful for suppressing dust and no additional facilities need be provided.

Water, constituting the high-pressure fluid, is supplied to the tool at a pressure of at least about 400 bars and preferably 500–1000 bars.

A tool made in accordance with the invention can discharge its jet at an angle or substantially perpendicular to the mineral or coal face. In the former case the jet can impinge on the face in the vicinity of the cutting region of the tool and preferably just in advance of the cutting action performed thereby. Where the jet impinges on the face normally thereto the jet can produce a kirving cut to relieve stresses in the face and can act at a distance from the cutting action.

In preferred embodiments of the invention the tool has a nozzle insert within its body and conveniently in a main bore therein. It is desirable to have the discharge mouth of the nozzle insert wholly within the body to protect the insert. A further bore, forming an extension of the main bore, can then convey the fluid or water from the nozzle insert to an exterior surface of the body to thereby create the jet. It is desirable to have the diameter of the further bore greater than the narrowest inner diameter of the nozzle insert and preferably two to ten times greater.

The further bore can penetrate the exterior surface directly or else via a frusto-conical recess.

In one embodiment of the invention the nozzle insert is located in a tubular member, and conveniently in a socket of the latter, and the tubular member engages in the main bore. Conveniently the tubular member is in screw-threaded engagement with the main bore permitting the tubular member to be removed with the nozzle insert.

The body of a tool made in accordance with the invention can be of flat plate-like form provided with a shank for reception in a pocket or compartment of a conventional holder. The body may be of one piece integral construction or alternatively the bore and nozzle insert can be in an attachment secured to a main plate-like body formed with a cutting region.

Preferably a tool made in accordance with the invention has connection means for accepting a hose or the like conveying water or fluid to the tool.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENT

Figure 1:
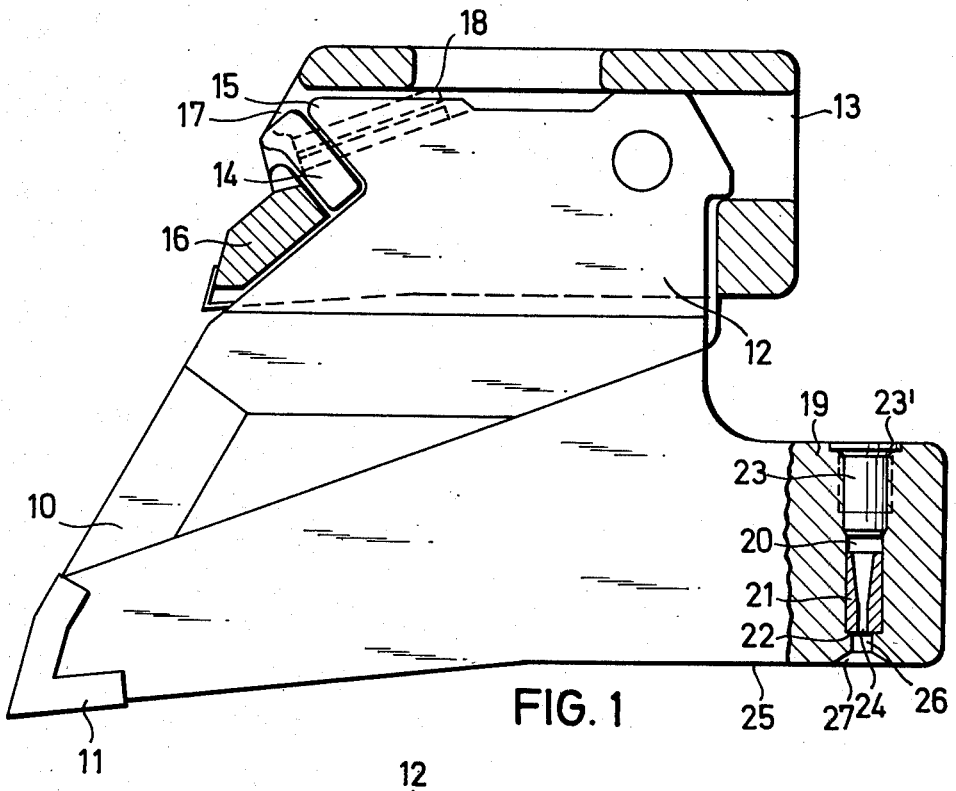
FIG. 1 is a part-sectional plan view of a tool assembly made in accordance with the invention.

As shown in FIG. 1 a tool or cutter-bit assembly consists of a tool or cutter bit 10 of flat plate-like form detachably carried by a holder which may form part of a machine, such as a plough. The tool 10 has a hardened cutting region or blade 11 which may be formed by a separate hard-metal insert welded or otherwise secured to the body of the basic tool 10. The tool 10 has a shaped shank portion 12 located in a pocket or compartment 13 of the associated holder as known per se. In the illustrated embodiment the tool 10 is held in the holder with the aid of a hook-shaped insert 14 which is located through an aperture 17 in the holder to engage between a nose 15 of the shank portion 12 and a wall portion 16 of the holder. The insert 14 is itself held captive by securing means such as a clamping sleeve 18 extending between the insert 14 and the shank portion 12. The sleeve 18 is accessible for release through a further aperture in the holder and by removing the sleeve 18 the insert 14 can be detached to permit the shank portion 12 to be swung out of the pocket 13.

At the part of the tool 10 remote from the cutting region 11 there is a region 19 which is here integral with the tool body although a separate attachment may form the region 19. The region 19 has a stepped main bore 20 which is intended to extend normally to a mineral working face when the tool 10 is in use. The bore 20 accommodates a nozzle insert 21 which locates against a shoulder 22 of the bore 20.

The nozzle insert 21 is detachably secured in the bore 20 with the aid of a hollow locking member 23 which is in screw-threaded engagement with the outer portion of the bore 20. The locking member 23 has an enlarged flange 23' which seats in a recess in the outer face of the end region 19 to lie flush with the outer face. A hose or the like (not shown) conveying high pressure fluid, usually water at 500–1000 bars, is coupled to the locking member 23 at the flanged outer end and the fluid passes through the locking member 23 to the nozzle insert 21. The mouth 24 of the nozzle insert 21 is disposed at the shoulder 22 and hence inwardly from the inner face 25 of the region 19 nearest the mineral face. The nozzle insert 21 is hence retained wholly within the end region 19. A further bore 26 coaxial with the main bore 20 and mouth 24 opens to a frusto-conical outlet recess 27 at the face 25. The diameter of the bore section 26 is preferably from two to ten times greater than the mouth 24 which defines the minimum internal diameter of the insert 21. The high pressure fluid or water thus passes from the mouth 24 of the nozzle insert 21 through the bore section 26 to emerge as a high pressure jet from the outlet 27 which impinges on the mineral face approximately perpendicularly thereto. This jet effects a kirving cut in the working face generally at a distance from the cutting action of the cutting region 11.

Figure 2:
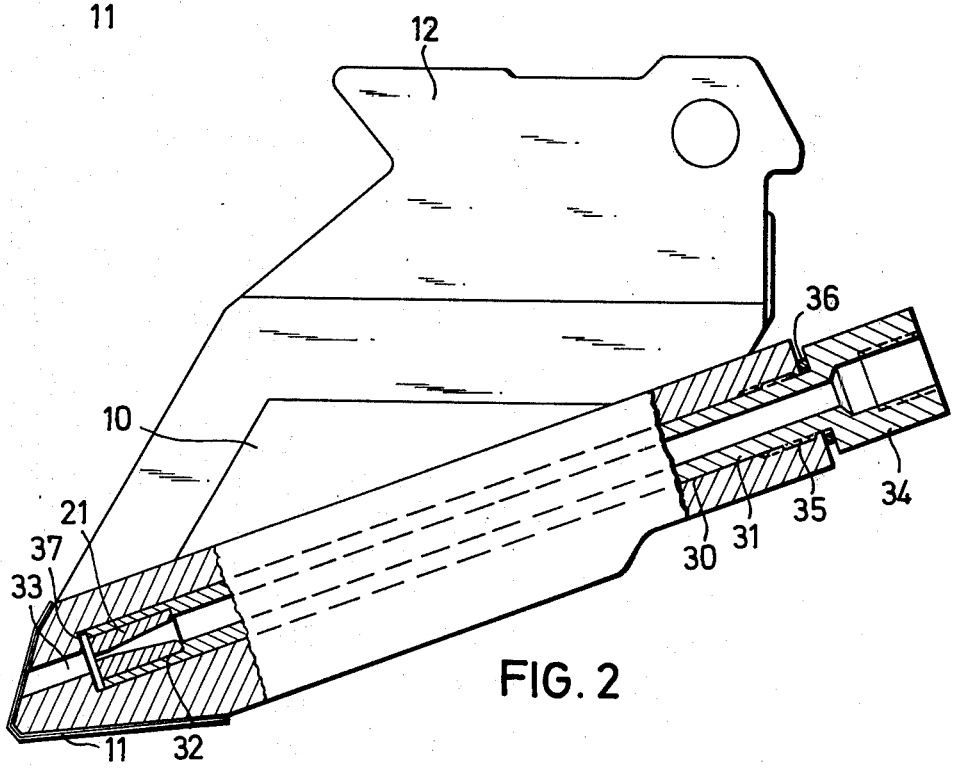
FIG. 2 is a part-sectional plan view of a tool made in accordance with the invention.

The tool 10 shown in FIG. 2 is similar to that illustrated in FIG. 1 and like reference numerals denote like parts. The tool 10 again has a shank portion 12 for engagement in a holder (not shown in FIG. 2). The main body of the tool 10 shown in FIG. 2 has an inclined through bore 30 which, in contrast to the arrangement shown in FIG. 1, is intended to extend at an acute angle with respect to the mineral face during use of the tool 10. A tubular member 31 is accommodated within the bore 30. The member 31 has an enlarged internal diameter portion or counterbore at the end nearest the cutting region 11 providing a socket 32 for receiving the nozzle insert 21. The main through bore 30 is coaxial with a reduced diameter end bore 33 opening to the cutting region 11. This bore 33 again has a diameter greater than the mouth or outlet of the nozzle insert 21. The tubular member 31 and the insert 21 may engage on a shoulder 37 formed at the junction between the main bore 30 and the reduced end bore 33. At the end remote from the insert 21, the member 31 is formed with a coupling piece 34 for receiving the hose or the like conveying high pressure fluid. This coupling piece 34 lies externally of the tool body and the member 31 has an external screw-threaded portion adjacent the coupling piece 34 which engages with an internal screw-threaded portion of the bore 30. Thus the member 31 can be detached at will and tightened to bring the insert 21 into abutment with the shoulder 37.

Figure 4:
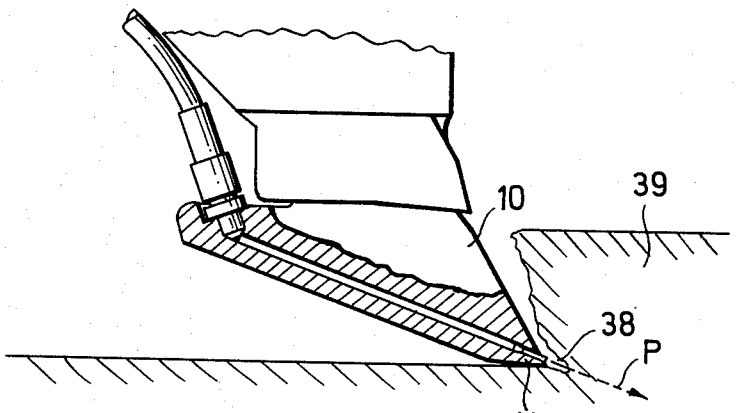
FIG. 4 is a part-sectional plan view of the tool shown in FIG. 2 in its operating position with respect to a mineral face.

A resilient seal, such as an O ring 36 is provided between the coupling piece 36 and the adjacent surface of the tool body. High pressure fluid or water enters the tubular member 31 via the coupling piece 34 and passes through the nozzle insert 21 and the bore 33 to emerge as a high pressure jet. In contrast to the FIG. 1 arrangement the jet of fluid, usually water, impinges on the mineral face at an acute angle preferably just in advance of the cutting action performed by the cutting region 11 of the tool. This is depicted more clearly in FIG. 4 where the jet P produced a kirving cut 38 in the mineral face 39 immediately in front of the cutting action of the cutting region 11.

Figure 3:
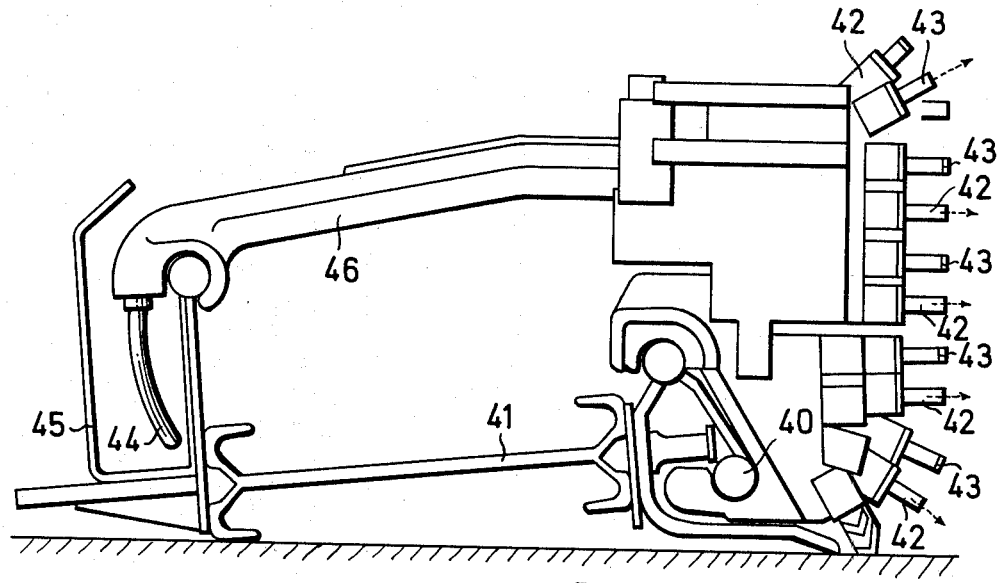
FIG. 3 is a schematic end view of a mineral winning installation with a winning machine employing tools made in accordance with the invention.

FIG. 3 depicts a mineral winning installation which employs a winning machine in the form of a plough supported for movement along a guide 40 at the mineral face side of a conveyor 41. The plough is driven back and forth along the conveyor 41 and the mineral face by means of a chain (not shown) running in channels of the guide 40 in known manner. The plough also has an arm 46 extending across the conveyor and locating on a further guide attached to the goaf side of the conveyor. The plough is provided with cutters 42 of conventional design which only perform a mechanical cutting action on the mineral face. The plough is also provided with tools 43 adapted to provide fluid jets. The tools 43 may be as shown in FIG. 1 or 2 thus performing a mechanical cutting action as well and are staggered as shown in relation to the conventional cutters 42 so that in the vertical sense the tools 43 are interspersed with the cutters 42 in alternating fashion.

Water under high pressure is supplied to the tools 43 by way of inter alia a hose 44 conducted through the arm 46. The hose 44 is dragged along behind the plough in known manner and is accommodated in a protective channel 45 at the goaf side of the conveyor 41.

I claim:

1. In or for a mineral winning machine, a non-rotary tool assembly comprising holding means and a tool detachably mounted to the holding means, the tool being provided with a cutting region and at least one nozzle for discharging a jet of high pressure fluid suitable for detaching mineral from a mineral face, said tool having a body with a detachable nozzle insert therein and wherein the body has a main bore containing the nozzle insert, and said nozzle insert has an outlet mouth communicating with a further bore coaxially with the main bore and leading to an exterior surface of the body.

2. A tool according to claim 1, wherein the further bore has a diameter in the range two to ten times greater than the narrowest internal diameter of the nozzle insert.

3. A tool according to claim 1, wherein the further bore leads to the exterior surface by way of a frustoconical recess.

4. A tool according to claim 1, wherein the nozzle insert is located in a tubular member engaged in the main bore.

5. A tool according to claim 4, wherein the tubular member is in screw-threaded engagement with the main bore.

6. A tool according to claim 4, wherein the tubular member is formed with a coupling piece for connection to fluid supply means.

7. A tool according to claim 1, wherein the nozzle insert is located in a stepped bore wholly within the body and a detachable locking member in screw-threaded engagement with part of the bore locates the insert in position.

8. A tool according to claim 1, wherein the body has a shank portion for engagement in the holding means.

9. A tool according to claim 1, wherein the main bore is provided in an attachment to a flat plate like member.

10. A tool assembly according to claim 1 wherein the nozzle is recessed within the body at an angle to discharge the jet substantially perpendicularly to a mineral face during the use of the tool.

11. A tool assembly according to claim 1 wherein the nozzle is recessed within the body at an angle to discharge the jet at an angle to a mineral face during use.

12. A tool assembly according to claim 1 wherein the nozzle is recessed within the body in a position to discharge the jet at a position spaced from the cutting region.

13. A tool assembly according to claim 1 wherein the nozzle is recessed within the body at a position to discharge the jet at a position adjacent the cutting region.

14. A mineral winning machine equipped with conventional cutters and additional non-rotary tool assemblies staggered in alternate manner to intersperse with the conventional cutters, wherein each additional non-rotary tool assembly comprises holding means and a tool mounted to the holding means, said tool comprising a body having a cutting region and at least one detachable nozzle insert contained in a main bore within the body, said nozzle being connected by way of a further bore concentric with the main bore to an exterior surface of the body, said nozzle insert and coaxial bore serving to discharge a jet of high pressure fluid suitable to detach mineral from a mineral face.

* * * * *